United States Patent [19]

Lessard

[11] Patent Number: 4,494,381

[45] Date of Patent: Jan. 22, 1985

[54] CRYOPUMP WITH IMPROVED ADSORPTION CAPACITY

[75] Inventor: Philip A. Lessard, Acton, Mass.

[73] Assignee: Helix Technology Corporation, Waltham, Mass.

[21] Appl. No.: 494,758

[22] Filed: May 13, 1983

[51] Int. Cl.[3] ..... B01D 8/00

[52] U.S. Cl. ..... 62/55.5; 55/269; 62/268; 415/90; 417/901

[58] Field of Search ..... 62/55.5, 100, 268; 415/90; 417/901; 55/269

[56] References Cited

U.S. PATENT DOCUMENTS

| | | | |
|---|---|---|---|
| 2,831,549 | 4/1958 | Alpert | 62/55.5 |
| 3,130,563 | 4/1964 | Wood et al. | 62/404 |
| 3,256,706 | 6/1966 | Hansen | 62/55.5 |
| 3,309,844 | 3/1967 | Hemstreet et al. | 55/75 |
| 3,335,550 | 8/1967 | Stern | 62/55.5 |
| 3,416,326 | 12/1968 | Stuffer | 62/55.5 |
| 3,490,247 | 1/1970 | Wing | 62/55.5 |
| 3,502,596 | 3/1970 | Sowards | 252/477 |
| 4,198,829 | 4/1980 | Carle | 62/55.5 |
| 4,295,338 | 10/1981 | Welch | 62/55.5 |

OTHER PUBLICATIONS

Liu et al.; "On Cryosorption Pumping of Hydrogen with the ZDB-150 Type Cryopump Cooled by a Two Stage Closed-Cycle Refrigerator" Journal of Vacuum Science Technology, vol. 20, No. 4, Apr. 1982, pp. 1000-1004.

*Primary Examiner*—Ronald C. Capossela

*Attorney, Agent, or Firm*—Hamilton, Brook, Smith and Reynolds

[57] ABSTRACT

A cryopump 20 with increased adsorptive capacity comprising a honeycomb adsorption structure 46 positioned within a second stage chevron assembly 40. Multiple chambers 58 of the honeycomb are covered with adsorbent charcoal 68. The entire structure 46 is attached to a second stage 52 of a cryogenic refrigerator 45.

11 Claims, 4 Drawing Figures

CRYOPUMP WITH IMPROVED ADSORPTION CAPACITY

DESCRIPTION

1. Technical Field

This invention relates to cryopumps, specifically to cryopumps used in applications where large amounts of hydrogen, helium, or neon must be removed from a work environment.

2. Background

Cryopumps are frequently used to remove gases from a work environment and to hold that environment at high vacuum. Many processes require near perfect vacuum environments to obtain good results. In some processes, large amounts of hydrogen, helium or neon, gases which do not condense well at easily attainable cryogenic temperatures, are present in the work environment. These gases must be adsorbed by an adsorbent placed within the coldest area of the cryopump. Adsorption is a process whereby gases are physically captured by a material held at cryogenic temperatures and thereby removed from an environment.

Cryopumps, however, need to be regenerated from time to time after large amounts of gas have been collected; otherwise they become inefficient. Regeneration is a process wherein the cryopump is allowed to return to ambient temperatures. Gases previously captured by the cryopump are released into the environment during regeneration and removed by a secondary pumping means. Following this release of gas, the cryopump is turned back on and is again capable of removing large amounts of gas from a work chamber.

In some processes such as sputtering, hydrogen gas is produced as a byproduct of the process and acts as a contaminant. Unfortunately excess hyudrogen leads to an increased need to regenerate the cryopump due to the increased adsorbtion of hydrogen. This results in a reduction of the period of time in which it takes the cryopump adsorbent to be filled to capacity. It is therefore evident that in certain processes cryopump capacity is limited to the amount of non-condensing gas the cryopump is capable of adsorbing.

Typically, some cryopump surfaces in the interior of the pump which operate at temperatures below 20° K., are coated with a charcoal, zeolite, or powdered metal material. At very low temperatures these adsorbent materials physically capture gas molecules. Molecular motion of the gas serves to bring them into contact with these surfaces.

In conventional cryopumps a first stage array of baffles or chevrons blocks gases from direct access to a second stage, or coldest temperature arrays. The second stages of many cryopumps comprise vanes or chevrons, some of which are coated with adsorbent material. Another example of a second stage array is where the interior of an inverted cup is coated with an adsorbent material. Cryopumps made in this fashion are subject to frequent regeneration.

A need therefore exists for an increased capacity cryopump capable of adsorbing large amounts of non-condensing gases.

SUMMARY OF THE INVENTION

A cryopump incorporating the principles of this invention comprises a cryopump housing having a port for fluid communication with a work chamber, a multistage refrigerator and cryopanels mounted to low temperature heat sinks on the refrigerator. Enclosed within the lowest temperature cryopanel is a honeycomb structure comprising multiple chambers coated with an adsorbent material. The honeycomb adsorbent structural is maintained in thermal communication with the lowest temperature heat sink.

In a preferred embodiment of the invention, the cryopump refrigerator has two stages. The second stage is the lower temperature refrigerator on which is mounted a low temperature heat sink. A second stage cryopanel is mounted to the low temperature heat sink and encloses the honeycomb structure.

This honeycomb structure has several different embodiments. In a first embodiment the honeycomb structure comprises a frustoconical array of adsorbent chambers substantially enclosed within the second stage cryopanel. Interlocking vertical and horizontal partitions are brazed together to produce five-side chambers coated with adsorbent material. The frustoconical array of adsorbent chambers is open to indirect fluid communication with the interior environment of the cryopump by means of passeges between the chevrons of the second stage cryopanel.

In another but similar embodiment the honeycomb structural is a cylindrical matrix of similar construction to the frustoconical matrix. These chambers are also only open to the interior environment of the cryopump by means of indirect fluid communication past the chevrons of the second stage cryopanel.

Finally, in yet another embodiment, the second stage cryopanel is shaped as an inverted cup. In the interior of the inverted cup a cylindrical matrix of chambers is positioned adjacent to the inner wall of the cup. These chambers are open to fluid communication with an open annulus formed between the cylindrical matrix and the second stage refrigerator. The annulus is open to the interior environment of the cryopump through an annular port at the base of the inverted cup.

DETAILED DESCRIPTION OF THE INVENTION

Figure 1:
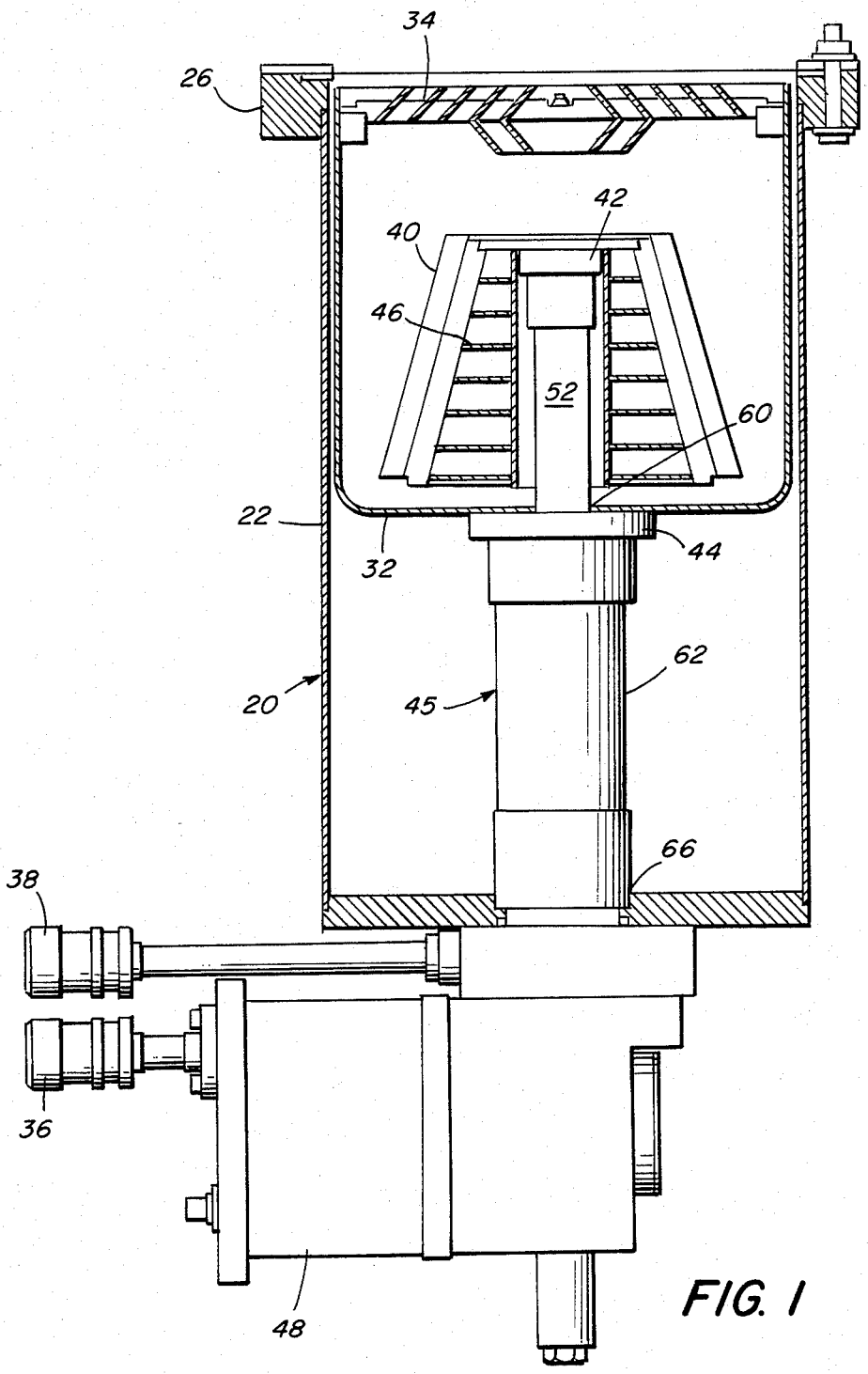
FIG. 1 is a cross section of a cryopump having increased adsorbent capacity and embodying the principles of this invention.

FIG. 1 is a cross sectional view of a cryopump incorporating principles of this invention which enable it to adsorb large quantities of gas.

A cryopump 20 in FIG. 1 comprises a main cryopump housing 22 which may be mounted directly to a work chamber on flange 26 or to an intermediate gate valve between it and the work chamber. A two-stage cold finger 45 of a cryogenic refrigerator protrudes into the housing through opening 66. In this case the refrigerator is a Gifford-MacMahon cycle refrigerator but others may be used.

The refrigerator includes a displacer in the cold finger 45 which is driven by a motor 48. Helium gas is introduced to and removed from the cold finger 45 by lines 38 and 36. Helium gas entering the cold finger is expanded by the displacer and thus cooled in a manner which produces very cold temperatures. Such a refrigerator is disclosed in U.S. Pat. No. 3,218,815 to Chellis et al.

A first stage pumping surface 34 is mounted to a cold end heat sink 44 of a first stage 62 of the refrigerator 45 through a radiation shield 32. Similarly, a second stage pumping array 40 is mounted to a cold end heat sink 42 of a second stage 52 of the refrigerator. The second stage refrigerator 52 of the cold finger extends through an opening 60 at the base of the radiation shield 32.

The cup-shaped radiation shield 32 mounted to the first stage heat sink 44 operates at about 77° Kelvin. The radiation shield surrounds the second stage cryopumping area and minimizes the heating of that area by direct radiation and higher condensing temperature vapors. The first stage pumping surface comprises a front chevron and/or array 34 which serves as both a radiation shield for the second stage pumping area and a cryopumping surface for higher condensation temperature gases such as water vapor. The frontal chevron array 34 shown here is a typical configuration but the frontal array may be constructed in several different ways and still be effective in the collection of higher condensation temperature gases. This chevron array allows the passage of lower condensation temperature gases through to the second stage pumping area.

The second stage pumping surface comprises a set of chevrons 40 arranged in a frustoconical, array. The chevron array is mounted to the heat sink 42 and operates at a temperature of about 15° Kelvin. The surfaces of the chevrons making up the array form a cryopumping surface whereby low condensing temperature gases cryocondense and are removed from the environment. There are, however, some gases which will not condense even at the extremely low temperatures found on the second stage cryopumping array. These gases, such as hydrogen, helium and neon, are the so-called Type III gases. An adsorbent is used to remove Type III gases from the cryopump and work chamber.

Enclosed within the chevron array 40 of the second stage is a frustoconical adsorbent honeycomb 46. The honeycomb is mounted to the second stage heat sink 42 and is thus held at about the second stage operating temperature of 15° Kelvin. This honeycomb is better understood with reference to the perspective view of FIG. 2.

The frustoconical honeycomb is made up of vertical partitions 54 and horizontal disks 56. As shown in the broken-away portion of FIG. 2, both the partitions 54 and the disks 56 have slots 55, 57 which allow for easy interlocking assembly. The partitions 54 and the disks 56 are brazed together at their intersections to form a unified construct. Central core 70, is positioned within the central holes in the disks and is also brazed into position.

The honeycomb is constructed of an oxygen-free high conductivity copper (OFHC) which assures operation at temperatures approaching that of the second stage heat sink 42 (i.e. 15° Kelvin). Together the partitions 54 and disks 56 form a series of enclosed areas 58 in which all the exposed surfaces are covered with adsorbent material such as the charcoal 68. The unified construct is assembled to the refrigerator 45 prior to the assembly of the first and second stage chevrons.

The honeycomb 46 maximizes the charcoal mass and surfaces area by utilizing both the vertical surfaces 54 and horizontal surfaces 56 interlaced about the central core 70 to form five sided boxes 58. Charcoal of an intermediate size range is securely attached to the walls of the boxes. In this embodiment charcoal is coated on all five surfaces made up of the disks, vertical partitions and core. The charcoal is pressed onto an epoxy coating previously applied to the honeycomb.

The vertical array of chevrons 40 shown in FIG. 1 surrounding the honeycomb plays an important part in allowing the adsorbent array to operate at maximum efficiency. Gas access to the adsorbent array is limited since the chevrons remove condensable gas prior to residual gas entry into the adsorbent array, thus only non-condensing gases are allowed to reach the adsorbent. Low condensing temperature gases such as argon, nitrogen and oxygen cryocondense on the chevron array 40. The adsorbent array 46 is thereby protected from an overload of condensable gases. The remaining Type III gases such as hydrogen, neon and helium are adsorbed by the charcoal.

Figure 3:
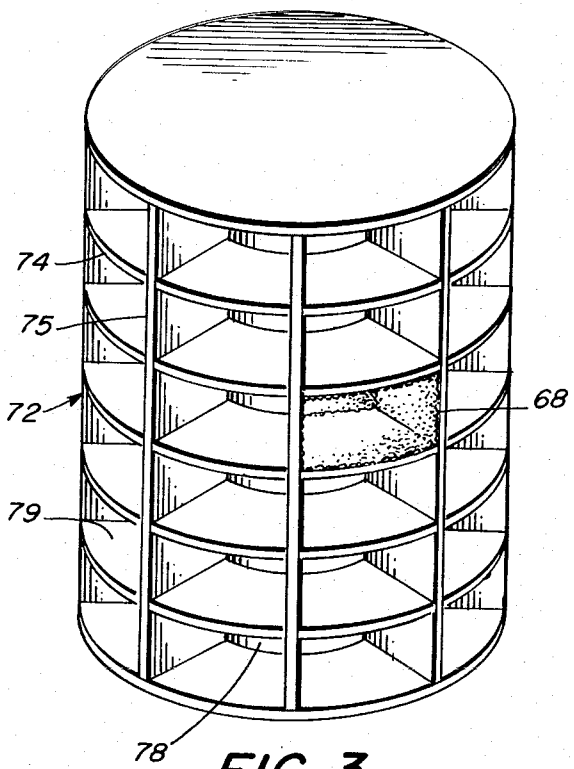
FIG. 3 is a perspective view of an alternative adsorbent array embodying the principles of the invention.

FIG. 3 discloses an alternate embodiment of an adsorbent array embodying principles of the invention. This honeycomb array 72 forms an annulus interspaced between a vertical second stage condensing array similar to the condensing array 40 of FIG. 1 and the second stage refrigerator 52. It is very similar in construction to the adsorbent array of FIGS. 1 and 2. Discs 74 form horizontal surfaces and partitions 75 form vertical surfaces. Both are slotted as shown in the prior embodiment of FIG. 2 so that vertical partitions 75 interlock with disks 74. The disks and partitions are brazed together to form a unified construct. An inner core 78 completes five (5) sided boxes 79. All the surfaces are coated with an adsorbent 68 which traps non-condensing gases.

Figure 2:
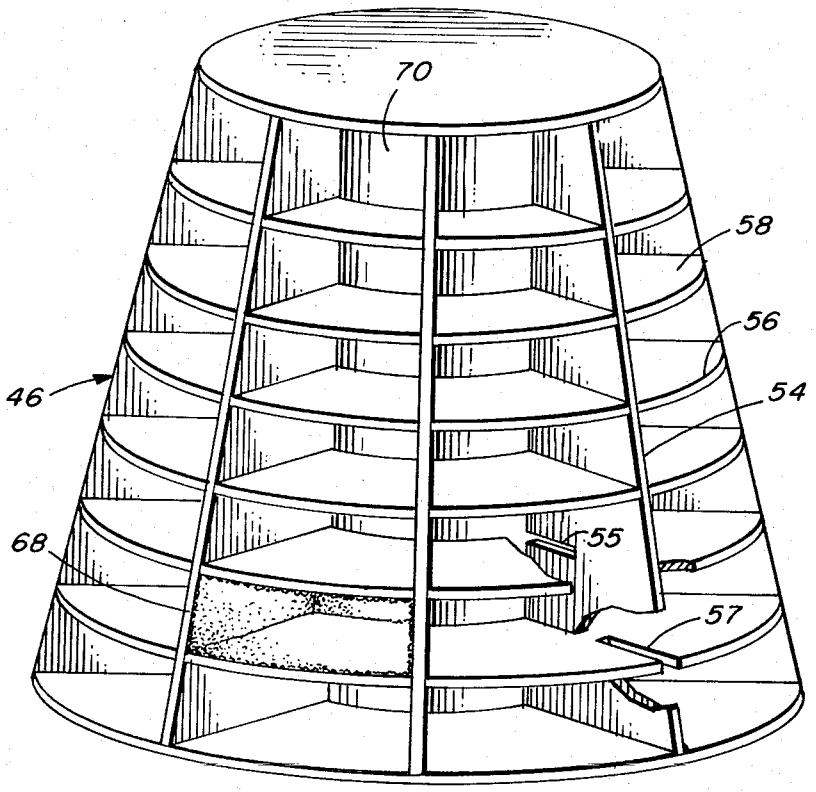
FIG. 2 is a perspective view of the honeycomb adsorbent array of FIG. 1.

The honeycomb designs as shown in FIGS. 1, 2 and 3 have been found capable of absorbing up to five times as much gas such as hydrogen as those in conventional pumps. The frustoconical design maximizes adsorbent area in a current type of cryopump housing without interfering with gas flow to the second stage element. The cylindrical design as shown in FIG. 3 also greatly increases the available adsorbent.

Figure 4:
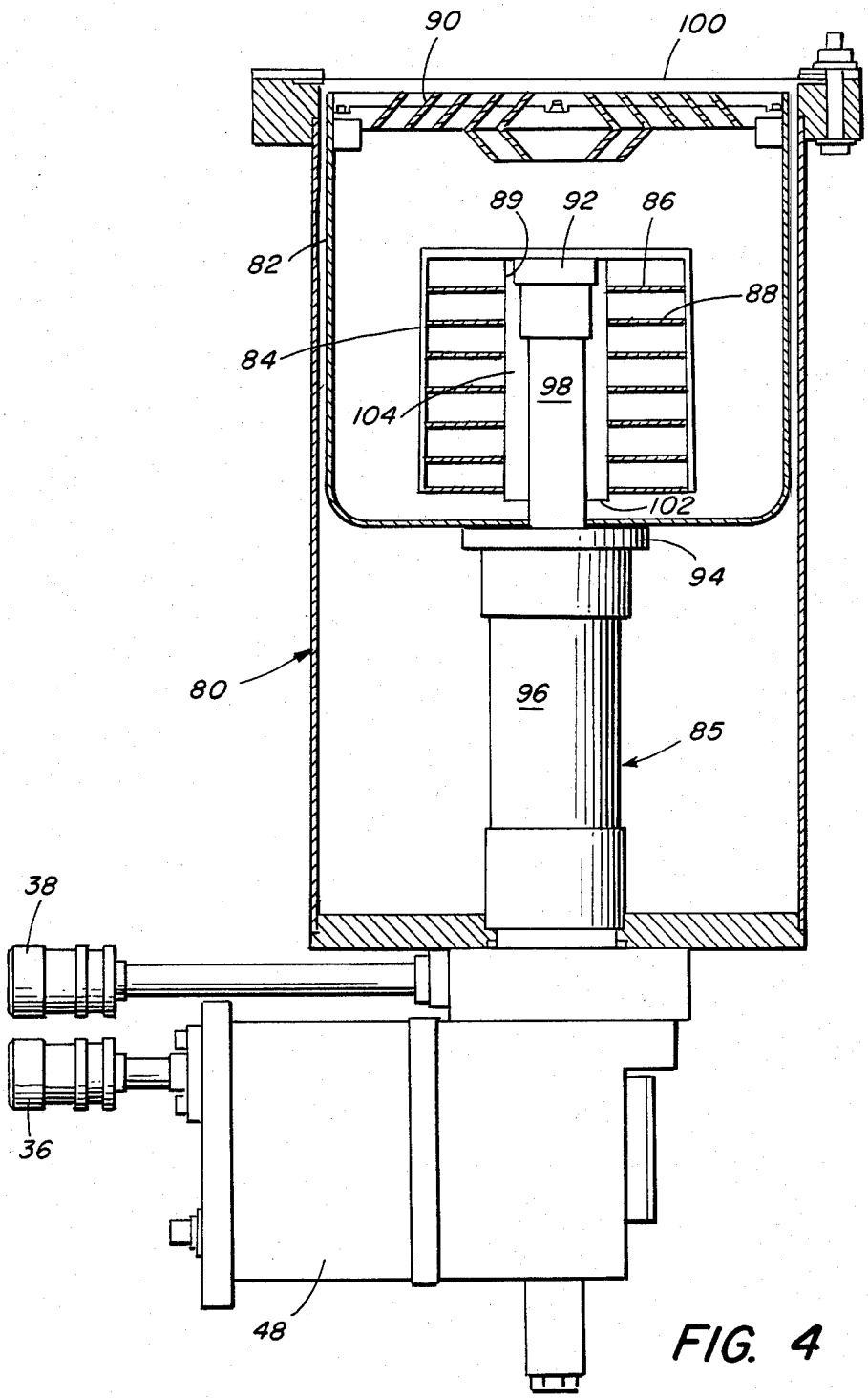
FIG. 4 is a cross section of yet another embodiment of the invention incorporating the principles discussed in relation to FIGS. 1 and 2.

FIG. 4 is a cross section of another embodiment of the invention. In this embodiment the honeycomb of FIG. 3 has been rearranged for gas entry at its base.

Cryopump 80 contains a two stage refrigerator 85. Chevrons and baffles 90 are attached through radiation shield 82 to a first stage heat sink 94 which is mounted upon the first stage 96 of the refrigerator 85. The chevrons 90 are positioned at inlet port 100 to form a condensation surface for higher condensing temperature gases.

Positioned within the radiation shield 82 and chevrons 90 is the second stage 98 of the refrigerator 85. A second stage condensing panel 84 is positioned upon a second stage heat sink 92. The heat sink 92 is mounted upon the second stage refrigerator 98. Lower condensing temperature gases condense upon the outer surfaces of the second stage condensing panel 84 which is shaped like an inverted cup. An adsorbent array 88 is positioned within the inverted cup of the second stage cryopanel 84. Both the second stage condensing surface and the adsorbent honeycomb are maintained at a very low temperature approaching the 15° Kelvin temperature of the second stage refrigerator 98.

Gas entering the second stage area from the inlet chevrons 90 must travel past the length of the second stage cryopanel 84 before it may enter the adsorbent array 88. In this way low condensing temperature gases are removed by the panel 84 before residual gas reaches the adsorbent array. Those gases not condensed upon the second stage, flow from below the cup 84 through annular space 102 into the interior of the second stage. Gases entering the interior of the second stage are adsorbed by the circular honeycomb surrounding the annulus 104.

The second stage refrigerator is surrounded vertical and horizontal partitions 89, 86. These partitions 89, 86 make up the radial honeycomb 88 which is similar to those shown in FIGS. 1 and 3. The inner surface of the cup 84 forms a back wall on each of the individual honeycomb chambers. The inside of the cup 84 and the surfaces formed by the partitions 89 and 86 are covered with adsorbent material. The five-sided chambers so formed are open ended facing inward towards the annulus 104 and adsorb the gases found there.

Conventional cup-like second stages have adsorbent material solely on the inner walls of the cub. The honeycomb configuration has increased the absorbent capacity of the cup-like second stages approximately three fold.

Increased absorbent capacity is particularly useful for manufacturing processes where hydrogen is one of the byproducts. In processes such as sputtering, a material deposit is bonded to a workpiece. Hydrogen is released by the process and becomes a serious contaminant which can prevent proper bonding of subsequent workpieces. The cryopump must quickly remove hydrogen from the environment to allow for continued manufacturing. In the cryopump disclosed herein, hydrogen gas, which has the lightest molecular weight of any element, is very quickly drawn through the first stage chevrons past the second stage cryopanel, and into the second stage adsorbing areas.

The invention therefore is most useful when the operations taking in vacuum require the adsorbtion of large amounts of hydrogen, helium or neon. While the invention has been particularly shown and described with reference to preferred embodiments thereof it will be understood by those skilled in the art that various changes in form or details may be made therein without departing from the spirit and scope of the invention as described in the appended claims.

I claim:

1. A cryopump comprising:

a. a cryogenic refrigerator;

b. a condensing cryopanel mounted to a low temperature heat sink on the refrigerator; and c. a honeycomb structure enclosed within said cryopanel, comprising an array of levels stacked along an axis, each level comprising a plurality of side-by-side chambers open radially from said axis with adsorbent material on their interiors, in thermal communication with said low temperature heat sink.

2. A cryopump as recited in claim 1 wherein the honeycomb structure comprises five sided chambers arranged in an annular matrix.

3. The cryopumps of claim 1 wherein said honeycomb structure comprises interlocking vertical partitions and disks which are brazed together to form a unified construct.

4. A cryopump comprising:

a. a cryogenic refrigerator in fluid commuinication with a work chamber, said refrigerator having a first stage and a second stage;

b. a second stage condensing cryopanel mounted to a low temperature heat sink on the second stage of the refrigerator; and c. a honeycomb structure enclosed within said second stage cryopanel, comprising an array of levels stacked along an axis, each level comprising a plurality of side-by-side chambers open radially from said axis coated on their interiors with an adsorbent material, in thermal communication with the second stage heat sink.

5. A cryopump as recited in claim 4 wherein the honeycomb structure comprises five sided chambers arranged in an annular matrix and open to the cryopump environment at an outer diameter of the annular matrix, and all of said sides of said chambers are coated with adsorbent.

6. A cryopump as recited in claim 4 wherein the honeycomb structure comprises a single brazed construct of oxygen free high conductivity copper.

7. A cryopump as recited in claim 4 wherein the honeycomb structure comprises a frustoconical array of adsorbent chambers substantially enclosed within said second stage cryopanel and in thermal communication with said second stage.

8. A cryopump as recited in claim 4 wherein the honeycomb structure comprises an inverted cup in thermal communication with the second stage refrigerator, the interior of said cup having a cylindrical matrix of adsorbent chambers positioned adjacent to an inner wall of the cup.

9. The cryopump of claim 4 wherein said honeycomb structure comprises interlocking vertical partitions and disks which are brazed together to form a unified construct.

10. A cryopump comprising:

a. a cryopump housing, said housing having a port for fluid communication with a work chamber;

b. a refrigerator within said housing having first and second stages;

c. a second stage condensing cryopanel in thermal communication with and surrounding the low temperature second stage;

d. a radiation shield partially enclosing said second stage cryopanel, in thermal contact with the first stage;

e. a frontal cryopanel extending across an opening in the radiation shield adjacent said port to said work chamber, the frontal cryopanel being in thermal contact with the first stage of the refrigerator; and f. a honeycomb structure coated with an adsorbent material in thermal communication with the second stage heat sink wherein the honeycomb structure comprises a matrix of chambers substantially enclosed within said second stage cryopanel, the matrix of chambers being formed by an array of circumferentially displaced partitions surrounding the second stage and extending generally radially and axially and an array of axially displacer walls extending radially to divide the spaces between the partitions into a plurality of chambers.

11. A cryopump comprising a cryogenic refrigerator having a low temperature heat sink and a honeycomb structure in thermal communication with the low temperature heat sink and comprising an array of levels stacked along an axis, each level comprising a plurality of side-by-side chambers open radially from said axis with an adsorbent materialon each wall thereof.

* * * * *